US008337342B1

(12) United States Patent
Huang

(10) Patent No.: US 8,337,342 B1
(45) Date of Patent: Dec. 25, 2012

(54) HYBRID ARROW INSERT

(76) Inventor: Dorge O'some Huang, Henry, IL (US)

( * ) Notice: Subject to any disclaimer, the term of this patent is extended or adjusted under 35 U.S.C. 154(b) by 0 days.

(21) Appl. No.: 13/298,157

(22) Filed: Nov. 16, 2011

(51) Int. Cl.
*F42B 6/04* (2006.01)
*F42B 6/08* (2006.01)

(52) U.S. Cl. ..... 473/582

(58) Field of Classification Search ..... 473/578, 473/582, 583
See application file for complete search history.

(56) References Cited

U.S. PATENT DOCUMENTS 5,636,846 A * 6/1997 Tinsley ..... 473/584
5,921,875 A * 7/1999 Bickel ..... 473/582
7,004,859 B2 * 2/2006 Palomaki et al. ..... 473/578
7,115,055 B2 * 10/2006 Palomaki et al. ..... 473/578
7,651,421 B2 * 1/2010 Smith et al. ..... 473/582
8,057,330 B2 * 11/2011 Blosser et al. ..... 473/582

* cited by examiner

*Primary Examiner* — John Ricci

(57) ABSTRACT

A dual step insert includes a head portion, a front neck portion, and a rear neck portion. An extension shaft is a tube shaped portion that includes an outside diameter, an inside diameter, and a wall thickness. An arrow shaft is a tube shaped structure that includes an outside diameter, an inside diameter, and a wall thickness. An outside rear neck portion of the dual step insert is used as an adhesive surface to adhesively couple the rear neck portion inside the front end of the extension shaft. Coupling of the dual step insert and the extension shaft create a dual step insert. The outside surface of the front neck portion and the outside surface of the extension shaft are now the adhesive surface for the dual step insert, which is adhesively coupled into the arrow shaft.

18 Claims, 1 Drawing Sheet

HYBRID ARROW INSERT

BACKGROUND OF THE INVENTION

1. Field of the Invention

The present invention relates generally to archery arrows and more specifically to an insert for an archery arrow.

2. Discussion of the Prior Art

Historically there have been many advancements in the art of archery. From the earliest time when man first affixed a flint point to the end of a slender stick, and propelled it form a bow, he has strived to increase the performance and accuracy of the arrow. New materials with greater strength, lighter weight projectiles, and aerodynamic vanes have all helped to increase performance, but there has always been an issue with dynamic forces on the arrow itself, and the consistent alignment of the arrow tip.

The present invention takes arrow performance to an all new level, by concentrically aligning the arrow insert, and strengthening the arrow shaft itself.

Prior art of an arrow insert has been good at best, where the neck of the point and the threads might be off concentrically from the arrow insert, and of the tip itself. All the archer could hope for was to screw the arrow tip into the arrow insert, and hope that they would align well enough to make the arrow fly with acceptable accuracy. A short, single piece insert that was not concentrically aligned negatively impacted the accuracy of the arrow. If the tolerances were poor on the insert or the shaft wall, it was nearly impossible to ensure concentric alignment of the arrow point, and consistent arrow flight. In addition to poor flight characteristics, the short insert, due to its length, has very little adhesive surface area. Having such a small adhesive surface, upon impact, it was common for the insert to come dislodged from the arrow shaft, thus forcing the insert and arrow tip rearward into the arrow shaft, causing the forward end of the arrow shaft to mushroom.

A problem with high powered bows has been the weakness of the spine of an arrow shaft. One cure for this was to increase the wall thickness of the entire arrow shaft, but this added unwanted and unneeded weight to the arrow, thus decreasing performance. Most recently, there have been developments in addressing the issue of spine stiffness. One uses a tapered shaft, larger at the front than the rear, and another claims a dual spine achieved by changing the wrapping sequence of the composite. These arrow shafts still rely on tolerances being met on both shaft and the short, single piece insert.

For the sake of clarification and definition, an arrow insert is a coupling means that is adhesively inserted into the end of an arrow shaft, wherein said coupling means is used to couple an arrow tip to an arrow. The present invention of the dual step insert allows for the increased adhesive surface area of the longer insert, which increases accuracy for concentric alignment of the insert, so as to concentrically align the point as it is screwed into the arrow insert.

By utilizing a dual step insert with an extension, the arrow shaft can be made much stiffer at the front, where it is needed, without adding weight to the entire arrow shaft, thus increasing performance and accuracy.

Advantageously, the present invention allows for an arrow insert that has a greater adhesive contact surface.

Advantageously, the present invention allows for precise adjustment to the overall arrow weight, by adjusting the length of the extension shaft. A longer extension shaft allows for greater weight, and a shorter extension shaft allows for lighter weight.

SUMMARY OF THE INVENTION

A dual step insert includes a head portion, a front neck portion, and a rear neck portion. An extension shaft is a tube shaped portion that includes an outside diameter, an inside diameter, and a wall thickness. An arrow shaft is a tube shaped structure that includes an outside diameter, an inside diameter, and a wall thickness. The dual step insert has a head portion diameter that is consistent with the outside diameter of the arrow shaft. The front neck portion diameter of the dual step insert is consistent with the outside diameter of the extension shaft. The rear neck portion diameter of the dual step insert is a diameter that is smaller than the inside diameter of the extension shaft. An outside rear neck portion of the dual step insert is used as an adhesive surface to adhesively couple the rear neck portion inside the front end of the extension shaft. Coupling of the dual step insert and the extension shaft create a hybrid arrow insert. The outside surface of the front neck portion and the outside surface of the extension shaft are now the adhesive surface for the hybrid arrow insert, which is adhesively coupled into the arrow shaft.

DETAILED DESCRIPTION OF THE PREFERRED EMBODIMENTS

Figure 1:
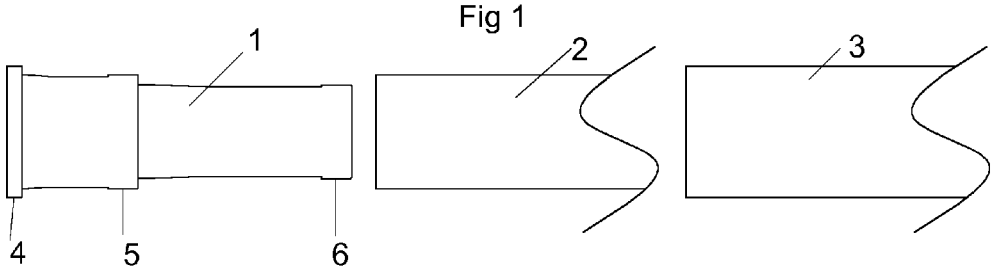
FIG. 1 is a view of the components of a dual step insert of the present invention.
Figure 2:
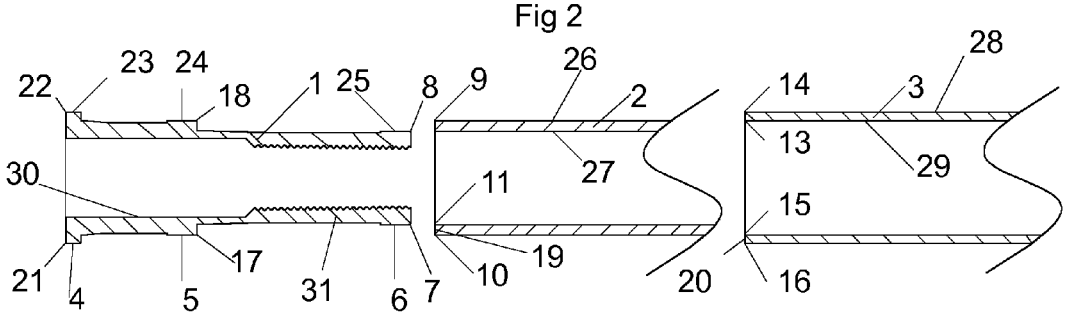
FIG. 2 is a cross section view of the components of a dual step insert of the present invention.

FIG. 1 and FIG. 2 are views of the components of a hybrid arrow insert of the present invention. A dual step insert 1 includes a head portion 4, a front neck portion 5, and a rear neck portion 6. The dual step insert 1 is preferably fabricated from a metallic material. An extension shaft 2 is a tube shaped portion that has an outside diameter, an inside diameter, and a wall thickness. The extension shaft 2 is preferably fabricated from a nonmetallic material. An arrow shaft 3 is a tube shaped structure that has an outside diameter, an inside diameter, and a wall thickness. For clarity as relates to dimensions of the dual step insert 1, arrow shaft 3 and the extension shaft 2, FIG. 2, FIG. 4, FIG. 5, and FIG. 6 are used. The extension shaft outside diameter dimension 26 is the vertical distance when measured from intersection point 9 to intersection point 10; the extension shaft inside diameter dimension 27 is the vertical distance when measured from intersection point 11 to intersection point 12; the outside diameter dimension 28 of the arrow shaft 3 is the vertical distance when measured from intersection point 14 to intersection point 16; an inside diameter dimension 29 of the arrow shaft 3 is the vertical distance when measured from intersection point 15 to intersection point 13. The front neck portion diameter 24 of the dual step insert 1 and the outside diameter 26 of the extension shaft 2 are preferably smaller than the inside diameter 29 of the arrow shaft 3 by at least 0.001 inches. The dual step insert 1 has a head portion diameter 23 that is consistent with the outside diameter 28 of the arrow shaft 3. The front neck portion diameter 24 of the dual step insert 1 is preferably consistent with the outside diameter 26 of the extension shaft 2. A thread tap 31 is formed on an inner perimeter 30 to threadably receive an arrow tip (not shown).

Figure 3:
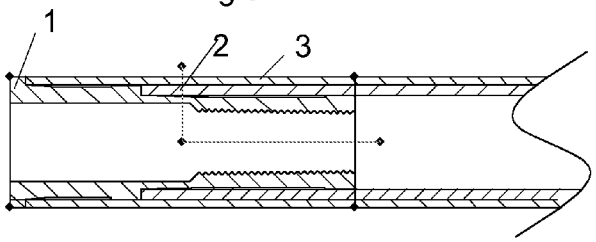
FIG. 3 is a cross section view of the assembled components of a hybrid arrow insert.
Figure 4:
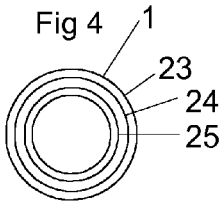
FIG. 4 is an end view of a dual step insert of the present invention.
Figure 5:
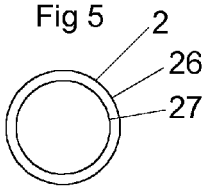
FIG. 5 is an end view of an extension shaft of the present invention.
Figure 6:
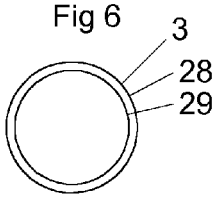
FIG. 6 is an end view of an arrow shaft of the present invention.

The rear neck portion diameter 25 of the dual step insert 1 is a diameter that is preferably smaller than the inside diameter 27 of the extension shaft 2 by at least 0.001 inches. The extension shaft wall thickness 19 dimension is no greater than the vertical distance between points 17 and 7 of the dual step insert 1. The arrow shaft wall thickness 20 is no greater dimension than the vertical distance between point 21 and 17 of the dual step insert 1. The outside rear neck portion 6 of the dual step insert 1 is used as an adhesive surface to adhesively couple the rear neck portion 6 inside the front end of the extension shaft 2. Once the dual step insert 1 and the extension shaft 2 have been coupled, they become the hybrid arrow insert. A length of the hybrid arrow insert is preferably at least 1.5 inches. The outside surface of the front neck portion 5 and the outside surface of the extension shaft 2 are now the adhesive surface for the hybrid arrow insert, which is adhesively coupled into the arrow shaft 3, as shown in FIG. 3.

What I claim is:

1. A hybrid arrow insert comprising:

an extension shaft having an outer perimeter and an inner perimeter; and a dual step insert having a first outer perimeter and second outer perimeter, said first outer perimeter is located on substantially a first end of said dual step insert, said second outer perimeter extends from one end of said first outer perimeter, a front neck portion is formed around said first outer perimeter, a rear neck portion is formed around said second outer perimeter, said rear neck portion is sized to be received by said inner perimeter of said extension shaft, wherein said front neck portion and said outer perimeter of said extension shaft are sized to be received by an inner perimeter of an arrow shaft.

2. The hybrid arrow insert of claim 1 wherein:

a head is formed on said first end of said dual step insert.

3. The hybrid arrow insert of claim 1 wherein:

a perimeter of said rear neck portion is at least 0.001 inches less than said inner perimeter of said extension shaft.

4. The hybrid arrow insert of claim 1 wherein:

a perimeter of said front neck portion and said outer perimeter of said extension shaft are at least 0.001 inches less than said inner perimeter of the arrow shaft.

5. The hybrid arrow insert of claim 1 wherein:

assembly of said dual step insert and said extension shaft forms a hybrid arrow insert, a length of said hybrid arrow insert is at least 1.5 inches.

6. The hybrid arrow insert of claim 1 wherein:

said inner perimeter of said dual step insert includes a thread tap.

7. A hybrid arrow insert comprising:

an extension shaft having an outer perimeter and an inner perimeter; and a dual step insert having a first outer perimeter and second outer perimeter, said first outer perimeter is located on substantially a first end of said dual step insert, said second outer perimeter extends from one end of said first outer perimeter, a front neck portion is formed around said first outer perimeter, a rear neck portion is formed around said second outer perimeter, said rear neck portion is sized to be received by said inner perimeter of said extension shaft, adhesive is applied to said second outer perimeter, said second outer perimeter is inserted into said inner perimeter of said extension shaft to form a hybrid arrow insert, wherein said front neck portion and said outer perimeter of said extension shaft are sized to be received by an inner perimeter of an arrow shaft, adhesive is applied to an outer perimeter of said hybrid insert, said hybrid arrow insert is inserted into the arrow shaft.

8. The hybrid arrow insert of claim 7 wherein:

a head is formed on said first end of said dual step insert.

9. The hybrid arrow insert of claim 7 wherein:

a perimeter of said rear neck portion is at least 0.001 inches less than said inner perimeter of said extension shaft.

10. The hybrid arrow insert of claim 7 wherein:

a perimeter of said front neck portion and said outer perimeter of said extension shaft are at least 0.001 inches less than said inner perimeter of the arrow shaft.

11. The hybrid arrow insert of claim 7 wherein:

assembly of said dual step insert and said extension shaft forms a hybrid arrow insert, a length of said hybrid arrow insert is at least 1.5 inches.

12. The hybrid arrow insert of claim 7 wherein:

said inner perimeter of said dual step insert includes a thread tap.

13. A hybrid arrow insert comprising:

an extension shaft having an outer perimeter and an inner perimeter, said extension shaft is fabricated from a non-metallic material; and a dual step insert having a first outer perimeter and second outer perimeter, said dual step insert is fabricated from a metallic material, said first outer perimeter is located on substantially a first end of said dual step insert, said second outer perimeter extends from one end of said first outer perimeter, a front neck portion is formed around said first outer perimeter, a rear neck portion is formed around said second outer perimeter, said rear neck portion is sized to be received by said inner perimeter of said extension shaft, wherein said front neck portion and said outer perimeter of said extension shaft are sized to be received by an inner perimeter of an arrow shaft.

14. The hybrid arrow insert of claim 13 wherein:

a head is formed on said first end of said dual step insert.

15. The hybrid arrow insert of claim 13 wherein:

a perimeter of said rear neck portion is at least 0.001 inches less than said inner perimeter of said extension shaft.

16. The hybrid arrow insert of claim 13 wherein:

a perimeter of said front neck portion and said outer perimeter of said extension shaft are at least 0.001 inches less than said inner perimeter of the arrow shaft.

17. The hybrid arrow insert of claim 13 wherein:

assembly of said dual step insert and said extension shaft forms a hybrid arrow insert, a length of said hybrid arrow insert is at least 1.5 inches.

18. The hybrid arrow insert of claim 13 wherein:

said inner perimeter of said dual step insert includes a thread tap.

* * * * *